US006344171B1

(12) United States Patent
Nomura

(10) Patent No.: US 6,344,171 B1
(45) Date of Patent: Feb. 5, 2002

(54) COPPER ALLOY FOR ELECTRICAL OR ELECTRONIC PARTS

(75) Inventor: Koya Nomura, Shimonoseki (JP)

(73) Assignee: Kobe Steel, Ltd., Kobe (JP)

( * ) Notice: Subject to any disclaimer, the term of this patent is extended or adjusted under 35 U.S.C. 154(b) by 0 days.

(21) Appl. No.: 09/638,066

(22) Filed: Aug. 15, 2000

(30) Foreign Application Priority Data

Aug. 25, 1999 (JP) ..... 11-238568

(51) Int. Cl.[7] ..... C22C 9/00
(52) U.S. Cl. ..... 420/473; 148/433
(58) Field of Search ..... 420/472; 148/433

(56) References Cited

U.S. PATENT DOCUMENTS

| | | | |
|---|---|---|---|
| 4,430,298 | A | 2/1984 | Miyafuji et al. |
| 4,656,003 | A | 4/1987 | Miyafuji et al. |
| 4,822,562 | A | 4/1989 | Miyafuji et al. |
| 4,990,309 | A | 2/1991 | Miyafuji et al. |
| 5,624,506 | A | 4/1997 | Tsuzaki et al. |
| 6,136,104 | A | 10/2000 | Miyafuji et al. |

FOREIGN PATENT DOCUMENTS

| | | | |
|---|---|---|---|
| EP | 0 399 070 | | 11/1990 |
| JP | 1168830 | * | 7/1989 |
| JP | 1-191755 | | 8/1989 |
| JP | 4180532 | * | 6/1992 |
| JP | 5-051671 | | 3/1993 |
| JP | 5-051672 | | 3/1993 |
| JP | 7-258774 | | 10/1995 |
| JP | 7-258775 | | 10/1995 |
| JP | 7-258805 | | 10/1995 |
| JP | 7-258806 | | 10/1995 |
| JP | 9-087814 | | 3/1997 |
| JP | 09 111373 | * | 4/1997 |
| JP | 9-157775 | | 6/1997 |
| JP | 9-291323 | | 11/1997 |
| JP | 9-296237 | | 11/1997 |
| JP | 110 80 862 | * | 3/1999 |
| JP | 11-350055 | | 12/1999 |
| WO | WO 99/05331 | | 2/1999 |

* cited by examiner

*Primary Examiner*—Sikyin Ip
(74) *Attorney, Agent, or Firm*—Oblon, Spivak, McClelland, Maier & Neustadt, P.C.

(57) ABSTRACT

Provided is a copper alloy for electrical or electronic parts which is superior in yield strength, electric conductivity, spring limit value, resistance property of stress relaxation, bendability and Sn plating property. The copper alloy for electrical or electronic parts comprises Fe: 0.5–2.4% ("%" means "% by mass", which is the same hereinafter.), Si: 0.02–0.1%, Mg: 0.01–0.2%, Sn: 0.01–0.7%, Zn: 0.01–0.2%, Pb: 0.0005–0.015%, P: less than 0.03%, Ni: 0.03% or less, and Mn: 0.03% or less, and further comprises Cu and inevitable impurities as the balance of the copper alloy.

7 Claims, No Drawings

COPPER ALLOY FOR ELECTRICAL OR ELECTRONIC PARTS

BACKGROUND OF THE INVENTION

1. Field of the Invention

The present invention relates to a copper alloy for electrical or electronic parts such as a terminal, a connector, a relay and a bus bar, and in particular to a copper alloy for electrical or electronic parts which has superior strength (yield strength), electric conductivity, spring limit value, resistance property of stress relaxation, bendability and Sn plating property.

2. Description of the Related Art

Electrical equipment for cars is increasing. In such a situation, the number of connectors is also increasing in wire harness for connecting a battery or a controller to various electrical parts, actuators, sensors or the like. It has been demanded to make the connectors compact. Connectors mounted near an engine section are always under high temperature and high vibration environment based on the engine section. When a large electric current is sent particularly to a connector for supplying electric power, the connector generates heat by itself so that the temperature thereof rises up to a higher temperature. Therefore, it has been demanded that such a connector (particularly, a female terminal) has high reliability under the above-mentioned environment (that is, looseness does not arise).

As a material of a copper alloy connector for conventional cars or the like, Cu—Fe—P alloys (CDA19400) or Cu—Mg—P alloys are known. The former alloys are alloys whose strength is improved by precipitation of Fe—P compounds based on co-addition of Fe and P. There are also known an alloy whose migration-resistance is improved by further addition of Zn (see JP-A-No. 1-168830); an alloy whose resistance property of stress relaxation is improved by addition of Mg (see JP-A-No. 4-358033); and the like. The latter alloys are alloys whose strength and thermal creep property are improved by addition of both of Mg and P so as to improve tensile strength, electric conductivity and resistance property of stress relaxation (JP-B-No. 1-54420).

In order to make wiring connectors (particularly, female terminals) for electrical parts for cars compact and keep their reliability (keeping their contact/press power), it is necessary to make the strength (yield strength) and the spring property (spring limit value) of the material of the connectors higher. In order that looseness is not caused (that is, fitting power does not drop by passage of time) even if the connectors are kept at high temperature for a long time, it is necessary to improve their resistance property of stress relaxation. At the same time, it is necessary that their electric conductivity is improved to suppress self generation of heat. Besides, it is demanded that the above-mentioned material has superior formability (particularly, bendability) in order to form small-sized connectors and this material has superior adhesiveness to Sn plating in order to decrease contact resistance between male and female terminals and improve corrosion resistance.

However, Cu—Fe—P copper alloys, which are conventional materials of connectors, are superior in formability, but have a problem that their spring limit value is low and their resistance property of stress relaxation is poor. In alloys wherein Mg is added to such alloys, their spring limit value is improved but their formability and electric conductivity are lowered. Cu—Mg—P copper alloys are superior in resistance property of stress relaxation but are poor in formability and adhesiveness to Sn plating.

SUMMARY OF THE INVENTION

In the light of such problems in the prior art, the present invention has been made. An object of the present invention is to provide a copper alloy for electrical or electronic parts which has superior yield strength, electric conductivity, spring limit value, resistance property of stress relaxation, bendability and Sn plating property.

The copper alloy for electrical or electronic parts of the present invention comprises Fe: 0.5–2.4% ("%" means "% by mass", which is the same hereinafter.), Si: 0.02–0.1%, Mg: 0.01–0.2%, Sn: 0.01–0.7%, Zn: 0.01–0.2%, P: less than 0.03%, Ni: 0.03% or less, and Mn: 0.03% or less, and further comprises Cu and inevitable impurities as the balance of the alloy.

If necessary, the copper alloy for electrical or electronic parts of the present invention may comprise Pb: 0.0005–0.015%, and/or may comprises one or more of Be, Al, Ti, V, Cr, Co, Zr, Nb, Mo, Ag, In, Hf, Ta and B in their total amount of 1% or less.

The amount of each of Bi, As, Sb and S as the inevitable impurities of the copper alloy is set up to 0.003% or less, and the total amount of these impurities is set up to 0.005% or less from the viewpoint of the production of the copper alloy. From the viewpoint of the same, the amount of O is preferably limited to 10 ppm or less and the amount of H is preferably limited to 20 ppm or less.

The copper alloy for electrical or electronic parts according to the present invention has all of properties which are required for such electrical or electronic parts as a terminal, a connector, a relay and bus bar. The above-mentioned properties include strength (yield strength), electric conductivity, spring limit value, resistance property of stress relaxation, bendability, and Sn plating property. The copper alloy is especially suitable for wiring materials for cars and in particular for materials of small-sized connectors for supplying electric power.

In the copper alloy for electrical or electronic parts according to the present invention, Si, which has deoxidization effect, is added and the added amount of P, which blocks uniform recrystallization, is made as small as possible. Thus, the copper alloy can be produced at low costs and with high productivity.

DETAILED DESCRIPTION OF THE INVENTION

Components or composition of the copper alloy for electrical or electronic parts of the present invention will be described hereinafter.

Fe

Fe is precipitated in this copper alloy to improve its strength. However, if Fe is contained in an amount over 2.4%, coarse Fe grains are crystallized or precipitated to lower its bendability. On the other hand, if the amount is below 0.5%, Fe is not easily precipitated to lower the strength and the electric conductivity of the alloy. Moreover, grains of recrystallization grow so that cracks are easily generated upon bending. Therefore, the amount of Fe is set up to 0.5–2.4% and preferably 1.0–2.1%. Within this range, the yield strength and the resistance property of stress relaxation of the alloy are further improved. The amount of Fe is more preferably from 1.8 to 2.0%. Within this range, the effect of suppressing the generation of cracks upon hot-rolling is improved.

Si

Si causes the copper alloy to be deoxidized instead of conventional P (both of Fe and Si contribute to deoxidization). Si has the effect of suppressing recrystallization-blocking-effect of P to promote uniform and fine recrystallization if the amount of P is below 0.03%. Si also has the effect of improving the resistance property of stress relaxation and the spring limit value of the alloy without lowering the electric conductivity thereof very much. If the amount of Si is below 0.02%, these effects are not sufficiently exhibited. On the otherhand, if the amount of Si is over 0.1%, the bendability deteriorates. The amount of Si is therefore from 0.02 to 0.1% and preferably from 0.03 to 0.07%. Within this range, the resistance property of stress relaxation of the alloy is further improved.

Mg

If Mg and solid-solution Sn are co-added to the copper alloy, Mg has the effect of improving its resistance property of stress relaxation and its spring limit value. However, Mg is easily oxidized. If the amount of Mg is large, melting in the atmosphere becomes difficult to lower the electrical conductivity of the alloy. For these reasons, in the copper alloy, Si compensates for a part of effects of Mg and Sn. If the amount of Mg is over 0.2% in the copper alloy (Cu—Fe alloy), uniform recrystallization is blocked so that the bendability of the copper alloy deteriorates. Above all, the resistance property of stress relaxation is not improved if the amount of Mg is below 0.01%. The amount of Mg is therefore set up to 0.01–0.2% and preferably 0.05–0.15%. Within this range, the resistance property of stress relaxation and the spring limit value of the copper alloy are further improved by co-addition of Mg and Sn. If Mg and Sn are not co-added, the resistance property of stress relaxation and the like are not improved.

Sn

If Sn and solid solution Mg are co-added to the copper alloy, Sn has the effect of improving its spring limit value and its resistance property of stress relaxation to a large extent, and improving its bendability. However, if the amount of Sn is over 0.7%, the electric conductivity of the alloy is lowered. Above all, the spring limit value and the bendability thereof are not improved if the amount of Sn is below 0.01%. Therefore, the amount of Sn is set up to 0.01–0.7% and preferably 0.05–0.15%. Within this range, the spring limit value, the resistance property of stress relaxation and the bendability are further improved by the co-addition of Sn and solid solution Mg.

Zn

Zn has a great effect of preventing exfoliation of Sn plating and solder plating. However, if Zn is contained in an amount over 0.2%, Zn is removed and the bendability of the copper alloy also deteriorates. On the other hand, if the amount of Zn is below 0.01%, exfoliation of Sn plating and solder plating is not prevented. The amount of Zn is therefore set up to 0.01–0.2% and preferably 0.1–0.2%. Within this range, the above-mentioned effect is great.

P

P gets mixed as an inevitable impurity. Alternatively, if necessary, P is added to the copper alloy to assist deoxidization and improve its fluidity. However, if the amount of P is large, uniform recrystallization is blocked. The amount of P is therefore setup to less than 0.03% (including 0%). If the amount of P is 0.03% or more, uniform and fine recrystallization texture cannot be obtained in intermediate annealing even if Si is added in an amount of 0.02% or more. In this case, portions which have not yet been recrystallized remain even if the temperature of the intermediate annealing is raised. As a result, the hardness of resultant copper alloy plates is scattered so that the bendability thereof deteriorates. The portions which have not yet been recrystallized cannot be caused to vanish under conditions of annealing ordinarily performed in mass production process even if the number of annealing steps is increased to 2 or more.

The amount of P is preferably set up to 0.005% or less. This is because in copper alloys comprising Fe, Si, Mg and Sn in amounts within the above-mentioned ranges, a peak of an improvement in the electrical conductivity by precipitation of Fe upon intermediate annealing can be made substantially consistent with the finishing of recrystallization of the copper alloy (that is, the recrystallization can be substantially finished when the electric conductivity reaches a peak) by limiting the amount of P within this range. In this way, high electric conductivity and superior bendability can be made compatible.

Ni

Ni gets mixed as an inevitable impurity. Alternatively, if necessary, Ni is added to the copper alloy since Ni has the effect of strengthening grain boundaries therein and preventing the generation of cracks upon hot-rolling. However, if the amount of Ni is over 0.03%, Ni—Si intermetallic compounds are produced to lower the resistance property of stress relaxation of the copper alloy. The amount of Ni is therefore set up to 0.03% or less (including 0%).

Mn

Mn gets mixed as an inevitable impurity. Alternatively, if necessary, Mn is added to the copper alloy since Mn has the effect of strengthening grain boundaries therein and preventing the generation of cracks upon hot-rolling. However, if the amount of Mn is over 0.03%, Mn—Si intermetallic compounds are produced to lower the resistance property of stress relaxation of the copper alloy. The amount of Mn is therefore set up to 0.03% or less (including 0%) and preferably 0.01% or less.

Pb

Pb gets mixed as an inevitable impurity. Alternatively, if necessary, Pb is added to the copper alloy to improve machinability and punching quality of the copper alloy. Pb has no effect on respective properties of final product plates. However, if Pb is contained in an amount over 0.015%, Pb is segregated in grain boundaries so that cracks are generated upon hot-rolling. On the other hand, if the amount of Pb is less than 0.0005%, the above-mentioned effect is not exhibited. The amount of Pb is therefore set up to 0.015% or less (including 0%). If the above-mentioned is required, Pb is caused to be contained in an amount of 0.0005% or more.

Be, Al, Ti, V, Cr, Co, Zr, Nb, Mo, Ag, In, Hf, Ta and B

These elements get mixed as inevitable impurities. Alternatively, if necessary, they are added to the copper alloy since they have the effect of raising recrystallization temperature and improving the resistance property of stress relaxation. However, if these elements are precipitated or crystallized, the electric conductivity of the copper alloy is lowered. Therefore, the total amount thereof is limited to 1% or less and preferably 0.5% or less.

Bi, As, Sb, S, O and H

These elements get mixed as inevitable impurities. Since Bi, As, Sb and S are segregated in grain boundaries to generate cracks upon hot-rolling, the amount of each of them is preferably limited to 0.003% or less and the total amount thereof is preferably limited to 0.005% or less. If the amount of O or H is large, blow holes are generated in the ingot. If the amount of O is large, a large amount of oxides is produced in the melt to block the fluidity of the melt. Therefore, the amount of O is preferably limited to 10 ppm or less, and the amount of H is preferably limited to 20 ppm or less.

As will be described in the following Examples, the above-mentioned copper alloy for electrical or electronics parts can be produced by an ordinary method of performing casting, homogenizing treatment, hot-rolling, cold-rolling, intermediate annealing, final cold-rolling and finishing annealing. The cold-rolling and the intermediate annealing may be repeated two or more times if necessary. If annealing is performed at 650–750° C. for a short time (5–20 seconds) between the cold-rolling and the intermediate annealing, recrystallization is beforehand caused during this annealing. Thus, Fe grains which block recrystallization are not precipitated. If this plate material in the recrystallization state is annealed in the subsequent intermediate annealing, Fe is precipitated so that the electric conductivity and strength of the plate material are improved and further texture wherein no texture that has not yet been recrystallized remains can be obtained. Therefore, the bendability thereof can be further improved.

EXAMPLES

Working examples of the copper alloy for electrical or electronic parts of the present invention will be described hereinafter, as compared with comparative examples.

Copper alloys having compositions shown in Tables 1 and 2 (examples of the present invention) and Tables 3 and 4 (comparative examples) were molten, with being coated with charcoal, under the atmosphere in a kryptol furnace and then cast. It was judged whether casting was possible or impossible.

Next, the ingots were held at 800–1000° C. for 30 minutes, and then subjected to hot-rolling with a reduction ratio of 50–80% to produce plates having a thickness of 18 mm. It was judged with eyes and by a fluorescence inspection method whether cracks were generated upon the hot-rolling. The fluorescence inspection method was performed by applying a fluorescent penetrant inspection liquid, SUPER GLOW DN-280011 made by MARKTEC CORPORATION to the whole surfaces of the test pieces, washing them with water, drying them, spraying a developer, SUPER GLOW DN-600S made by MARKTEC CORPORATION onto them to develop them, and irradiating them with ultraviolet rays.

TABLE 1

| No. | Cu | Fe | Si | P | Mg | Sn | Zn | Ni | Mn | Pb |
|---|---|---|---|---|---|---|---|---|---|---|
| 1 | Balance | 2.36 | 0.031 | — | 0.11 | 0.10 | 0.15 | — | — | 0.0005 |
| 2 | Balance | 1.36 | 0.045 | — | 0.11 | 0.11 | 0.16 | — | — | 0.0005 |
| 3 | Balance | 1.78 | 0.031 | — | 0.014 | 0.013 | 0.16 | — | — | 0.002 |
| 4 | Balance | 1.81 | 0.033 | — | 0.014 | 0.11 | 0.16 | — | — | 0.0005 |
| 5 | Balance | 1.80 | 0.026 | — | 0.097 | 0.012 | 0.17 | — | — | 0.003 |
| 6 | Balance | 1.79 | 0.030 | — | 0.095 | 0.098 | 0.14 | — | — | 0.0005 |
| 7 | Baiance | 1.85 | 0.054 | 0.001 | 0.086 | 0.090 | 0.15 | 0.001 | 0.001 | 0.004 |
| 8 | Balance | 1.83 | 0.059 | 0.001 | 0.099 | 0.092 | 0.15 | 0.001 | 0.001 | 0.004 |
| 9 | Balance | 0.57 | 0.054 | — | 0.011 | 0.14 | 0.15 | 0.001 | 0.001 | 0.0005 |
| 10 | Balance | 2.38 | 0.054 | — | 0.12 | 0.11 | 0.13 | 0.001 | 0.001 | 0.0005 |
| 11 | Balance | 1.91 | 0.020 | — | 0.13 | 0.11 | 0.16 | — | — | 0.0005 |
| 12 | Balance | 1.94 | 0.092 | — | 0.13 | 0.11 | 0.16 | — | — | 0.0005 |
| 13 | Balance | 1.91 | 0.054 | 0.008 | 0.13 | 0.11 | 0.15 | 0.001 | 0.001 | 0.0005 |
| 14 | Balance | 1.92 | 0.053 | 0.025 | 0.14 | 0.11 | 0.15 | 0.017 | 0.001 | 0.0005 |
| 15 | Balance | 1.82 | 0.034 | — | 0.11 | 0.12 | 0.014 | 0.008 | 0.001 | 0.0007 |
| 16 | Balance | 1.79 | 0.051 | — | 0.11 | 0.11 | 0.18 | 0.011 | 0.001 | 0.0005 |
| 17 | Balance | 1.91 | 0.051 | — | 0.19 | 0.17 | 0.15 | — | — | 0.0005 |
| 18 | Balance | 1.83 | 0.034 | 0.001 | 0.11 | 0.12 | 0.13 | 0.028 | — | 0.0005 |
| 19 | Balance | 1.81 | 0.055 | — | 0.14 | 0.098 | 0.17 | 0.001 | 0.027 | 0.0005 |
| 20 | Balance | 2.01 | 0.054 | — | 0.11 | 0.087 | 0.16 | 0.001 | 0.001 | 0.0006 |
| 21 | Balance | 1.98 | 0.048 | — | 0.095 | 0.12 | 0.16 | 0.001 | 0.001 | 0.012 |
| 22 | Balance | 1.98 | 0.055 | — | 0.13 | 0.32 | 0.15 | — | — | 0.0005 |
| 23 | Balance | 1.98 | 0.063 | — | 0.13 | 0.64 | 0.15 | — | — | 0.0005 |

TABLE 2

| No. | Bi | As | Sb | S | O# | H# | Other elements |
|---|---|---|---|---|---|---|---|
| 1 | 0.0001 | 0.0001 | 0.0001 | 0.0001 | 1 | 1.3 | |
| 2 | 0.0001 | 0.0005 | 0.0001 | 0.0001 | 1 | 1.2 | |
| 3 | 0.0005 | 0.0005 | 0.0001 | 0.0001 | 3 | 1.3 | |
| 4 | 0.0005 | 0.0005 | 0.0001 | 0.0001 | 2 | 1.4 | |
| 5 | 0.0001 | 0.0005 | 0.0001 | 0.0001 | 2 | 1.6 | |
| 6 | 0.0005 | 0.0006 | 0.0001 | 0.0001 | 1 | 1.7 | |
| 7 | 0.0005 | 0.0001 | 0.0005 | 0.0001 | 1 | 1.9 | |
| 8 | 0.0005 | 0.0001 | 0.0005 | 0.0001 | 1 | 1.8 | |
| 9 | 0.0005 | 0.0001 | 0.0005 | 0.0001 | 2 | 1.9 | Be: 0.001, In: 0.01, |

TABLE 2-continued

| No. | Bi | As | Sb | S | O# | H# | Other elements |
|---|---|---|---|---|---|---|---|
| | | | | | | | Ta: 0.01, B: 0.0001 |
| 10 | 0.0006 | 0.0002 | 0.0005 | 0.0002 | 1 | 1.3 | Nb: 0.0001, Mo: 0.001, Hf: 0.0001 |
| 11 | 0.0001 | 0.0005 | 0.0006 | 0.0003 | 1 | 1.4 | |
| 12 | 0.0001 | 0.0003 | 0.0001 | 0.0001 | 1 | 1.3 | |
| 13 | 0.0001 | 0.0001 | 0.0001 | 0.0001 | 2 | 1.2 | |
| 14 | 0.0002 | 0.0005 | 0.0001 | 0.0004 | 1 | 1.2 | |
| 15 | 0.0005 | 0.0005 | 0.0002 | 0.0001 | 1 | 1.1 | Cr: 0.0001, Al: 0.0001, Ti: 0.01, V: 0.0001 |
| 16 | 0.0003 | 0.0005 | 0.0005 | 0.0001 | 1 | 1.2 | Zr: 0.01, Co: 0.001 |
| 17 | 0.0001 | 0.0005 | 0.0003 | 0.0001 | 2 | 1.8 | |
| 18 | 0.0004 | 0.0006 | 0.0001 | 0.0025 | 1 | 2.4 | Ag: 0.001 |
| 19 | 0.0025 | 0.0001 | 0.0001 | 0.0001 | 1 | 2.1 | Cr: 0.0001, Al: 0.0001, Ti: 0.01, V: 0.0001 |
| 20 | 0.0001 | 0.0025 | 0.0001 | 0.0001 | 1 | 2.3 | In: 0.45 |
| 21 | 0.0001 | 0.0001 | 0.00025 | 0.0001 | 2 | 1.4 | Hf: 0.15 |
| 22 | 0.0001 | 0.0001 | 0.0001 | 0.0001 | 1 | 1.4 | |
| 23 | 0.0001 | 0.0001 | 0.0001 | 0.0001 | 1 | 1.2 | |

#ppm

TABLE 3

| No. | Cu | Fe | Si | P | Mg | Sn | Zn | Ni | Mn | Pb |
|---|---|---|---|---|---|---|---|---|---|---|
| 24 | Balance | 2.25 | —* | 0.029 | —* | —* | 0.16 | 0.001 | 0.001 | 0.0005 |
| 25 | Balance | —* | —* | 0.004 | 0.67* | —* | —* | 0.001 | 0.001 | 0.0005 |
| 26 | Balance | 2.28 | —* | 0.024 | 0.096 | 0.10 | 0.16 | 0.001 | 0.001 | 0.0005 |
| 27 | Balance | 1.73 | —* | 0.024 | 0.087 | 0.10 | 0.16 | 0.001 | 0.001 | 0.0005 |
| 28 | Balance | 0.39* | 0.054 | — | 0.014 | 0.11 | 0.16 | 0.001 | 0.001 | 0.0005 |
| 29 | Balance | 0.61 | 0.12* | — | 0.11 | 0.12 | 0.16 | 0.001 | 0.001 | 0.0005 |
| 30 | Balance | 1.92 | 0.053 | 0.04* | 0.14 | 0.11 | 0.16 | 0.001 | 0.001 | 0.0005 |
| 31 | Balance | 1.84 | 0.057 | — | 0.22* | 0.095 | 0.15 | 0.0001 | 0.0001 | 0.0005 |
| 32 | Balance | 1.78 | 0.026 | — | —* | —* | 0.16 | — | — | 0.0005 |
| 33 | Balance | 1.74 | 0.034 | — | —* | 0.008* | 0.16 | 0.0001 | 0.0001 | 0.0005 |
| 34 | Balance | 1.81 | 0.023 | — | —* | 0.11 | 0.15 | 0.0001 | 0.0001 | 0.0005 |
| 35 | Balance | 1.77 | 0.037 | — | 0.009* | —* | 0.16 | 0.0001 | 0.0001 | 0.0005 |
| 36 | Balance | 1.66 | 0.025 | — | 0.11 | —* | 0.15 | 0.0001 | 0.0001 | 0.0005 |
| 37 | Balance | 1.92 | 0.054 | — | 0.14 | 0.098 | 0.008* | 0.0001 | 0.0001 | 0.0005 |
| 38 | Balance | 1.81 | 0.035 | — | 0.097 | 0.099 | 0.22* | 0.0001 | 0.0001 | 0.0005 |
| 39 | Balance | 1.41 | 0.056 | — | 0.096 | 0.11 | 0.16 | 0.043* | 0.0001 | 0.0005 |
| 40 | Balance | 1.38 | 0.064 | — | 0.11 | 0.14 | 0.16 | 0.0001 | 0.041* | 0.0005 |
| 41 | Balance | 2.46* | 0.031 | — | 0.12 | 0.11 | 0.16 | 0.001 | 0.001 | 0.0005 |
| 42 | Balance | 1.81 | 0.009* | — | 0.014 | 0.011 | 0.012 | 0.001 | 0.001 | 0.0005 |
| 43 | Balance | 1.85 | 0.021 | — | 0.011 | 0.14 | 0.011 | 0.0001 | 0.0001 | 0.0003* |
| 44 | Balance | 1.83 | 0.022 | — | 0.014 | 0.12 | 0.012 | 0.0001 | 0.0001 | 0.018* |
| 45 | Balance | 1.92 | 0.023 | — | 0.011 | 0.098 | 0.013 | 0.0001 | 0.0001 | 0.0005 |
| 46 | Balance | 1.96 | 0.033 | — | 0.013 | 0.097 | 0.16 | 0.0001 | 0.0001 | 0.0005 |
| 47 | Balance | 1.75 | 0.029 | — | 0.011 | 0.12 | 0.14 | 0.0001 | 0.0001 | 0.0005 |
| 48 | Balance | 1.84 | 0.027 | — | 0.011 | 0.11 | 0.11 | 0.0001 | 0.0001 | 0.0005 |
| 49 | Balance | 2.81 | 0.021 | — | 0.012 | 0.13 | 0.12 | 0.0001 | 0.0001 | 0.0005 |
| 50 | Balance | 1.21 | 0.022 | — | 0.011 | 0.096 | 0.056 | 0.0001 | 0.0001 | 0.0005 |
| 51 | Balance | 2.09 | 0.024 | — | 0.013 | 0.095 | 0.062 | 0.0001 | 0.0001 | 0.0005 |

*Outside the range defined by the claims

TABLE 4

| No. | Bi | As | Sb | S | O# | H# | Other elements |
|---|---|---|---|---|---|---|---|
| 24 | 0.0001 | 0.0001 | 0.00025 | 0.0001 | 2 | 2.3 | |
| 25 | 0.001 | 0.001 | 0.001 | 0.001 | 1 | 1.8 | |
| 26 | 0.0001 | 0.0001 | 0.00025 | 0.0001 | 1 | 1.9 | |
| 27 | 0.0001 | 0.0001 | 0.00025 | 0.0001 | 1 | 1.8 | |
| 28 | 0.001 | 0.001 | 0.001 | 0.001 | 1 | 1.8 | |
| 29 | 0.001 | 0.001 | 0.001 | 0.001 | 1 | 1.9 | |
| 30 | 0.001 | 0.001 | 0.001 | 0.001 | 1 | 2.4 | |
| 31 | 0.0001 | 0.0001 | 0.0001 | 0.0001 | 1 | 1.5 | |
| 32 | 0.0001 | 0.0001 | 0.0001 | 0.0001 | 1 | 1.6 | |
| 33 | 0.0001 | 0.0001 | 0.0001 | 0.0001 | 1 | 1.8 | |
| 34 | 0.0001 | 0.0001 | 0.0001 | 0.0001 | 1 | 1.7 | |
| 35 | 0.0001 | 0.0001 | 0.0001 | 0.0001 | 1 | 2.1 | |
| 36 | 0.0001 | 0.0001 | 0.0001 | 0.0001 | 1 | 2.3 | |
| 37 | 0.0001 | 0.0001 | 0.0001 | 0.0001 | 1 | 1.4 | |
| 38 | 0.0001 | 0.0001 | 0.0001 | 0.0001 | 1 | 2.3 | |
| 39 | 0.0001 | 0.0001 | 0.0001 | 0.0001 | 1 | 1.6 | |
| 40 | 0.0001 | 0.0001 | 0.0001 | 0.0001 | 1 | 1.8 | |
| 41 | 0.001 | 0.001 | 0.001 | 0.001 | 1 | 1.4 | |
| 42 | 0.001 | 0.001 | 0.001 | 0.001 | 22* | 42* | |
| 43 | 0.0001 | 0.0001 | 0.0001 | 0.0001 | 1 | 1.7 | |
| 44 | 0.0001 | 0.0001 | 0.0001 | 0.0001 | 1 | 1.3 | |
| 45 | 0.0031* | 0.0003 | 0.0002 | 0.0001 | 1 | 2.3 | |
| 46 | 0.0006 | 0.0032* | 0.0001 | 0.0001 | 1 | 1.4 | |
| 47 | 0.0001 | 0.0001 | 0.0035* | 0.0002 | 1 | 2.3 | |
| 48 | 0.0003 | 0.0002 | 0.0001 | 0.0032* | 1 | 1.6 | |
| 49 | 0.0024* | 0.0016* | 0.0019* | 0.0011* | 2 | 1.8 | |
| 50 | 0.0001 | 0.0001 | 0.0001 | 0.0001 | 11* | 21* | |
| 51 | 0.0001 | 0.0001 | 0.0001 | 0.0001 | 3 | 2.3 | Ti: 0.24, Cr: 0.28, Zr: 0.11* Al: 0.23, In: 0.21 |

*Outside the range defined by the claims

In the next step, these hot-rolled plates were set in a scalper, and then it was judged whether or not galling was caused in a cutter edge in the scalper. The base metal of this cutter edge was made of a chromium-molybdenum steel, and the cutter edge portion thereof was made by brazing a hard metal chip of tungsten carbide to the base metal with silver solder. The rotating speed of the edge was 6 m/second, and the amount of cutting was 1.5 mm/face. Cutting oil and the like were not used. Twenty hot-rolled plates 200 mm in width, 18 mm in thickness and 180 mm in length were prepared for each of the above-mentioned alloys. The whole of both faces of all of them was subjected to facing so that the thickness of all of them would be 15 mm. Thereafter, the surface of the cutter edge was observed with an SEM and the galling state of the surface was examined. When the surface of the edge had a trace of deposition of molten chips, such a state was judged as generation of galling.

From the above-mentioned judgement standard, it was checked whether the production of the alloy plates according to the present invention was possible or impossible. The results are shown in Table 5.

As shown in Table 5, No. 44 could be cast, but the amount of added Pb was too large so that cracks were generated upon the hot-rolling.

No. 50 was not subjected to sufficient sealing for shading the melt from the atmosphere. Therefore, the amounts of H and O were large. For this reason, oxides of Si, Mg and Sn, which were added elements, were produced in the melt. The fluidity of the melt deteriorated extremely. Thus, casting was abandoned.

The casting and the hot-rolling of No. 43 were possible, but the amount of added Pb was small so that galling was caused in the cutter edge.

The casting of Nos. 45–49 were possible, but in Nos. 45–48 the amount of each of Bi, As, Pb and S was too large and in No. 49 the total amount of Bi, As, Pb and S was too large. In Nos. 45–49, therefore, cracks were generated in the hot-rolling.

The casting of No. 42 was possible, but the amount of Si as a deoxidization agent was small and P was not added. Therefore, the casting surface of the ingot was brittle and porous because of lack of deoxidization. The subsequent steps were therefore abandoned.

On the other hand, Nos. 1–23 having the composition within the range defined by the present invention (and Nos. 24–41 and 51, wherein the amounts of some elements were outside the range defined by the present invention) were good in ingot quality and hot-rolling ability. Moreover, the production of the hot-rolled plates was easy, and no galling was caused in the cutter edge so as to make the extension of the life span of the edge possible.

TABLE 5

| No. | Possibility or impossibility of production |
|---|---|
| 1–23 | Each of the alloys could be produced into a plate thickness of a final product. |
| 24–41 | Each of the alloys could be produced into a plate thickness of a final product. |
| 42 | Deoxidization was insufficient so that the surface of the resultant ingot was brittle and porous. |
| 43 | Galling was caused in the cutter edge. |
| 44 | The amount of Pb was excessive so that cracks were generated upon hot-rolling. |
| 45 | The amount of Bi was excessive so that cracks were generated upon hot-rolling. |
| 46 | The amount of As was excessive so that cracks were generated upon hot-rolling. |
| 47 | The amount of Sb was excessive so that cracks were generated upon hot-rolling. |
| 48 | The amount of S was excessive so that cracks were generated upon hot-rolling. |
| 49 | The total amount of Bi, As and S was excessive so that cracks were generated upon hot-rolling. |
| 50 | SiMgSr oxide was produced in the melt so that the fluidity thereof deteriorated. |
| 51 | The alloy could be produced into a plate thickness of a final product. |

Subsequently, the hot-rolled plates of Nos. 1–41 and 51 were cold-rolled so as to have a thickness of 2.5–0.50 mm. The plates were subjected to intermediate annealing in an electric furnace at 370–600° C. for 1–20 hours. Next, oxide scale was removed from these plates and then the recrystallization ratio an the hardness distribution of the plates were measured (details thereof will be described later). The plates were further cold-rolled so as to have a thickness of 0.25 mm. The plates were subjected to finishing annealing at 250–490° C. for from 5 second to 2hours. Conditions for producing the respective copper alloys are shown in Table 6. At last, these plates were pickled to remove oxide scale. In this way, plates as final products were produced. All alloys could be easily produced into the shape and the thickness of the final product.

TABLE 6

| No. | Plate thickness upon intermediate annealing (mm) | Intermediate annealing conditions | Finishing annealing conditions |
|---|---|---|---|
| 1 | 0.63 | 500° C. · 10 hours | 250° C. · 2 hours |
| 2 | 0.83 | 500° C. · 4 hours | 400° C. · 20 seconds |
| 3 | 1.25 | 450° C. · 2 hours | 350° C. · 20 seconds |
| 4 | 1.25 | 450° C. · 4 hours | 350° C. · 20 seconds |
| 5 | 0.83 | 500° C. · 4 hours | 400° C. · 20 seconds |
| 6 | 0.83 | 500° C. · 4 hours | 400° C. · 20 seconds |
| 7 | 0.83 | 500° C. · 4 hours | 400° C. · 20 seconds |
| 8 | 0.83 | 500° C. · 4 hours | 400° C. · 20 seconds |
| 9 | 2.50 | 400° C. · 2 hours | 350° C. · 20 seconds |
| 10 | 0.63 | 600° C. · 2 hours | 490° C. · 20 seconds |
| 11 | 1.25 | 450° C. · 2 hours | 350° C. · 20 seconds |
| 12 | 1.25 | 450° C. · 4 hours | 350° C. · 20 seconds |
| 13 | 0.83 | 500° C. · 4 hours | 400° C. · 20 seconds |
| 14 | 0.63 | 550° C. · 6 hours | 250° C. · 1 hour |
| 15 | 1.25 | 450° C. · 2 hours | 350° C. · 20 seconds |
| 16 | 1.25 | 450° C. · 2 hours | 350° C. · 20 seconds |

TABLE 6-continued

| No. | Plate thickness upon intermediate annealing (mm) | Intermediate annealing conditions | Finishing annealing conditions |
|---|---|---|---|
| 17 | 0.63 | 600° C. · 4 hours | 250° C. · 2 hours |
| 18 | 1.25 | 450° C. · 2 hours | 350° C. · 20 seconds |
| 19 | 0.83 | 500° C. · 4 hours | 400° C. · 20 seconds |
| 20 | 1.25 | 450° C. · 2 hours | 350° C. · 20 seconds |
| 21 | 1.25 | 450° C. · 2 hours | 350° C. · 20 seconds |
| 22 | 1.00 | 550° C. · 4 hours | 400° C. · 20 seconds |
| 23 | 1.00 | 550° C. · 5 hours | 450° C. · 20 seconds |
| 24 | 0.83 | 400° C. · 20 hours | 400° C. · 20 seconds |
| 25 | 1.00 | 500° C. · 1 hour | 260° C. · 1 hour |
| 26 | 0.83 | 550° C. · 12 hours | 400° C. · 20 seconds |
| 27 | 0.83 | 550° C. · 6 hours | 400° C. · 20 seconds |
| 28 | 2.50 | 370° C. · 2 hours | 250° C. · 5 seconds |
| 29 | 1.25 | 400° C. · 2 hours | 300° C. · 10 seconds |
| 30 | 0.83 | 550° C. · 4 hours | 450° C. · 20 seconds |
| 31 | 0.50 | 550° C. · 5 hours | 250° C. · 1 hour |
| 32 | 1.25 | 550° C. · 4 hours | 350° C. · 10 seconds |
| 33 | 1.25 | 550° C. · 4 hours | 350° C. · 10 seconds |
| 34 | 1.25 | 550° C. · 4 hours | 350° C. · 10 seconds |
| 35 | 1.25 | 550° C. · 4 hours | 350° C. · 10 seconds |
| 36 | 1.25 | 550° C. · 4 hours | 350° C. · 10 seconds |
| 37 | 0.83 | 550° C. · 4 hours | 400° C. · 20 seconds |
| 38 | 0.63 | 550° C. · 4 hours | 400° C. · 20 seconds |
| 39 | 0.83 | 550° C. · 4 hours | 400° C. · 20 seconds |
| 40 | 0.83 | 550° C. · 4 hours | 400° C. · 20 seconds |
| 41 | 0.90 | 550° C. · 4 hours | 260° C. · 1 hour |
| 51 | 0.90 | 550° C. · 4 hours | 260° C. · 1 hour |

About halfway plates obtained after the intermediate annealing in the above-mentioned production process and the final products, the following characteristics ①–⑨ were measured according to the following ways. The results are shown in Tables 7 and 8.

① Recrystallization Ratio After the Intermediate Annealing

The plates were embedded in a polishing resin so that sections of the plates could be observed. The sections were polished into mirror plates. Thereafter, the sections were observed with an optical microscope of 200 magnifications or more. The ratio of the area where recrystallization was completed in the whole surface area (100%) inside a visual field for observation was calculated. This ratio was used as the recrystallization ratio. If the recrystallization ratio is 90% or more, no effect are produced on mechanical properties of the final products, such as bendability.

② Standard Deviation of Measured Values of Hardness of the Plates After the Intermediate Annealing The surfaces of the plates were subjected to buffing and then a 10–100 g load micro Vickers' hardness meter was used to measure the hardness of 30 points at intervals of 50 μm in the direction perpendicular to the rolling direction. The standard deviation of the distribution of the 30 measured values was calculated. If the standard deviation is less than 5, recrystallization is evenly completed so that no effect is produced on mechanical properties of the final products, such as bendability.

③ Yield Strength of the Final Products

Yield strength, which is a mechanical property to which particular importance is attached for a material of connectors for cars, was measured by producing a JIS No. 5 tensile strength test piece by mechanical working and performing a universal testing machine UH-10B made by Shimadzu Corp. The yield strength is a tensile strength corresponding to a permanent elongation of 0.2%, defined by JIS Z 2241. If the yield strength is 450 N/mm$^2$ or more, it is possible to keep contact point fitting power, which is required for small-sized connectors for supplying electric power for cars, and resist power generated at the time of forcing a male terminal into a female terminal.

④ Electric Conductivity

Electric conductivity was measured by the four-terminal method using a double bridge 5752 made by Yokogawa Electric Corp. according to a method for measuring the electric conductivity of non-ferrous metals, defined by JIS H 0505. If the electric conductivity is 50%IACS or more, self generation of heat can be suppressed.

⑤ Spring Limit Value of the Final Products

The spring limit value was measured according to a spring limit value moment type test, defined by JISH 3130. If the spring limit value is 300 N/mm$^2$ or more, it is possible to keep contact point fitting power, which is required for small-sized connectors for supplying electric power for cars.

⑥ Upper Temperature About Resistance Property of Stress Relaxation of the Final Products The resistance property of stress relaxation was examined by the cantilever beam method. Specifically, rectangular test pieces having a width of 10 mm were cut out from the plates in the direction perpendicular to the rolling direction. One end thereof was fixed onto a testing rigid body stand. At the time of starting the present test, the test pieces were bent by 10 mm so as to apply, to the materials of the test pieces, a surface stress corresponding to 80% of the yield strength of the materials. Each of the materials was kept in respective ovens whose temperatures were set up to from 120 to 160° C. at intervals of 5° C. for 1000 hours. How much a bend L after removal of the load approached a bend of 10 mm inside the initial elastic range was measured. That is, the rate thereof: R=(10-L)/10×100 (%) was calculated and evaluated. In this evaluation, if the highest temperature making it possible to keep R=70% or more is 150° C. or higher, it is possible to keep contact point fitting power, which is required for small-sized connectors for supplying electric power for cars.

⑦ Limit Bending Radius of the Final Products Against 180° Bending in the Rolling Longitude Direction In the 180° bending test, test specimens worked into 10 mm in width and 35 mm in length were put between V block bending tool shaving respective bending radii by the V block method bending test defined by JIS Z 2248, and then a universal testing machine RH-30 made by Shimadzu Corp. was used to perform preliminary bending under a load of 1 ton. Furthermore, the preliminary-bent test pieces were put on a flat metallic table. The test pieces were caused to adhere to the table under a load of 1 tone with the universal testing machine RH-30 made by Shimadzu Corp. The bendability of the test pieces were evaluated by examining, through a loupe, whether cracks or the like were generated in the bent portions of the test specimens with regard to the respective bending radii of the above-mentioned bending tools. In this evaluation, if the minimum bending radius is 0 mm to a plate thickness of 0.25 mm, small-sized connectors for supplying electric power for cars can be molded.

⑧ Limit Bending Radius of the Final Products Against W Bending in the Rolling Perpendicularity Direction The bendability of W-shaped products is defined by CESM 0002 metal material W bending test. Test specimens worked into 10 mm in width and 35 mm in length were put between B type bending tools having respective bending radii, and then a universal testing machine RH-30 made by Shimadzu Corp. was used to perform bending under a load of 1 ton. In this way, the bendability was measured. The bendability of the test pieces were evaluated by examining, through a loupe, whether cracks or the like were generated in the bent portions of the test pieces with regard to the respective bending radii of the above-mentioned bending tools. In this evaluation, if the minimum bending radius is 0.125 mm or less to a plate thickness of 0.25 mm, small-sized connectors for supplying electric power for cars can be molded.

⑨ Existence or Non-existence of Exfoliation of Sn Plating of the Final Products

Concerning adhesiveness to Sn plating, the final products were subjected to plating with Sn at a current density of 2.5 A/dm$^2$ in a Sn plating bath (20° C.) comprising 40 g/liter of stannous sulfate, 100 g/liter of sulfuric acid, 30 g/liter of cresol sulfate, 5 milliliter/liter of formalin, 20 g/liter of a dispersing agent, and 10 milliliter/liter of a brightening agent. The thickness of the Sn plating was set up to 1.5 $\mu$m. Thereafter, the final products were heated in an oven at 105° C. for 500 hours, and were then bent by an angle of 180° with a radius of 2 mm. Subsequently, the bending of the products were recovered. It was examined with eyes whether the Sn plating was exfoliated from the products. In this evaluation, if the Sn plating is not exfoliated from a certain product, the product can be used for small-sized connectors for supplying electric power for cars.

About the final plate products, it was judged from observation of sections thereof whether or not the plate product had such alien substances that caused a deterioration in quality of the plate products, for example, oxides, coarse precipitations, coarse crystals, grain boundary reaction type precipitations. Specifically, the plate products were embedded in a polishing resin so that sections thereof could be observed. The sections of the plate products were subjected to polishing into mirror planes. Thereafter, the sections were observed with an optical microscope of 200 magnifications or more. In this way, it was checked whether or not the plate products had the above-mentioned alien substances.

Furthermore, the following was performed besides the observation with the optical microscope: 10 mm×10 mm×0.25 mm plate products were cut out from the center or both ends, as representative sites, of the final plate products. They were embedded in a polishing resin so that their sections could be observed. The sections were polished into mirror planes. Thereafter, the sections were observed with EDX-SEM to detect the alien substance, measure the size thereof, and identify the composition thereof. The case in which one or more oxides or crystals having a diameter of 1 $\mu$m or more are within a 30 $\mu$m×50 $\mu$m area is judged as existence of oxides or crystals.

TABLE 7

| No. | Recrystallization ratio after the intermediate annealing (%) | Standard deviation of hardness values after the intermediate annealing | Yield strength (N/mm$^2$) | Electrical conductivity (% IACS) | Spring limit value (N/mm$^2$) | Upper temperature about resistance property of stress relaxation (° C.) | Limit radius against 180° bending in the rolling longitude direction along rolling(mm) | Limit radius against W bending in the rolling perpendicularity direction (mm) | existence or absence of exfoliation of Sn plating |
|---|---|---|---|---|---|---|---|---|---|
| 1 | 100 | 4.1 | 549 | 55.6 | 375 | 150 | 0 | 0.125 | No exfoliation |
| 2 | 98 | 3.2 | 534 | 56.8 | 365 | 150 | 0 | 0 | No exfoliation |
| 3 | 99 | 3.3 | 474 | 62.6 | 310 | 150 | 0 | 0 | No exfoliation |
| 4 | 99 | 4.5 | 504 | 58.4 | 308 | 150 | 0 | 0 | No exfoliation |

TABLE 7-continued

| No. | Recrystal-lization ratio after the intermediate annealing (%) | Standard deviation of hardness values after the intermediate annealing | Yield strength (N/mm$^2$) | Electrical conduc-tivity (% lACS) | Spring limit value (N/mm$^2$) | Upper temperature about resistance property of stress relaxation (° C.) | Limit radius against 180° bending in the rolling longitude direction along rolling(mm) | Limit radius against W bending in the rolling perpendicularity direction (mm) | existence or absence of exfoliation of Sn plating |
|---|---|---|---|---|---|---|---|---|---|
| 5 | 98 | 4.1 | 519 | 59.3 | 342 | 150 | 0 | 0.125 | No exfoliation |
| 6 | 99 | 4.5 | 519 | 58.1 | 402 | 150 | 0 | 0.125 | No exfoliation |
| 7 | 99 | 3.3 | 519 | 56.0 | 312 | 150 | 0 | 0.125 | No exfoliation |
| 8 | 98 | 3.5 | 494 | 63.3 | 376 | 150 | 0 | 0 | No exfoliation |
| 9 | 100 | 3.2 | 470 | 54.0 | 402 | 160 | 0 | 0 | No exfoliation |
| 10 | 98 | 2.9 | 510 | 59.2 | 382 | 155 | 0 | 0 | No exfoliation |
| 11 | 99 | 2.9 | 487 | 63.1 | 372 | 150 | 0 | 0.125 | No exfoliation |
| 12 | 94 | 4.5 | 493 | 62.1 | 398 | 150 | 0 | 0.125 | No exfoliation |
| 13 | 91 | 4.6 | 508 | 62.5 | 388 | 150 | 0 | 0.125 | No exfoliation |
| 14 | 98 | 4.9 | 512 | 62.3 | 392 | 150 | 0 | 0.125 | No exfoliation |
| 15 | 99 | 4.1 | 513 | 61.8 | 402 | 155 | 0 | 0.125 | No exfoliation |
| 16 | 99 | 4 | 498 | 62.1 | 398 | 155 | 0 | 0.125 | No exfoliation |
| 17 | 98 | 4.2 | 500 | 61.8 | 396 | 150 | 0 | 0 | No exfoliation |
| 18 | 98 | 3.9 | 497 | 62.4 | 384 | 150 | 0 | 0 | No exfoliation |
| 19 | 98 | 3.4 | 504 | 59.9 | 398 | 160 | 0 | 0.125 | No exfoliation |
| 20 | 99 | 2 | 526 | 59.7 | 382 | 160 | 0 | 0.125 | No exfoliation |
| 21 | 97 | 2.8 | 515 | 61.3 | 341 | 155 | 0 | 0.125 | No exfoliation |
| 22 | 98 | 3.8 | 547 | 56.4 | 452 | 150 | 0 | 0.125 | No exfoliation |
| 23 | 98 | 3.7 | 550 | 51.3 | 483 | 150 | 0 | 0.125 | No exfoliation |

TABLE 8

| No. | Recrystal-lization ratio after the intermediate annealing (%) | Standard deviation of hardness values after the intermediate annealing | Yield strength (N/mm$^2$) | Electrical conduc-tivity (% lACS) | Spring limit value (N/mm$^2$) | Upper temperature about resistance property of stress relaxation (° C.) | Limit radius against 180° bending in the rolling longitude direction along rolling(mm) | Limit radius against W bending in the rolling perpendicularity direction (mm) | existence or absence of exfoliation of Sn plating |
|---|---|---|---|---|---|---|---|---|---|
| 24 | 75* | 11.3* | 493 | 65.0 | 231* | 120* | 0 | 0 | No exfoliation |
| 25 | 98 | 4.3 | 529 | 61.0 | 432 | 150 | 0.5* | 0.5* | Exfoliation* |
| 26 | 64* | 14.3* | 569 | 57.4 | 400 | 150 | 0.125* | 0.5* | No extoliation |
| 27 | 71* | 8.4* | 525 | 55.9 | 369 | 150 | 0.125* | 0.5* | No exfoliation |
| 28 | 94 | 3.8 | 380* | 61.2 | 291* | 140* | 0.125* | 0.125 | No exfoliation |
| 29 | 100 | 3.5 | 490 | 49.7* | 358 | 160 | 0.25* | 0.25* | No exfoliation |
| 30 | 74* | 9.8* | 498 | 59.2 | 378 | 150 | 0.25* | 0.5* | No exfoliation |
| 31 | 88* | 7.8* | 498 | 60.0 | 341 | 160 | 0.25* | 0.25* | No exfoliation |
| 32 | 98 | 4.6 | 475 | 62.2 | 235* | 150 | 0.125* | 0.25* | No exfoliation |
| 33 | 99 | 4.5 | 483 | 62.1 | 259* | 150 | 0.25* | 0.25* | No exfoliation |
| 34 | 94 | 2.8 | 502 | 58.8 | 324 | 140* | 0 | 0.125 | No exfoliation |
| 35 | 95 | 2.7 | 481 | 61.9 | 253* | 140* | 0.25* | 0.25* | No exfoliation |
| 36 | 98 | 4.3 | 530 | 60.0 | 328 | 140* | 0.25* | 0.25* | No exfoliation |
| 37 | 99 | 4.1 | 497 | 61.2 | 376 | 150 | 0 | 0 | Exfoliation* |
| 38 | 97 | 3.9 | 512 | 59.8 | 398 | 150 | 0.25* | 0.25* | No exfoliation |
| 39 | 96 | 2.9 | 487 | 63.8 | 378 | 140* | 0.25* | 0.25* | No exfoliation |
| 40 | 98 | 3.4 | 468 | 56.7 | 364 | 130* | 0.125* | 0.125 | No exfoliation |
| 41 | 91 | 4.9 | 520 | 62.0 | 350 | 140* | 1.0* | 0.5* | No exfoliation |
| 51 | 90 | 4.8 | 498 | 60.0 | 341 | 160 | 1.0* | 0.5* | No exfoliation |

*poor property

As shown in Table 7, Nos. 1–23, which had the composition within the range defined by the present invention, were superior in all of the properties. Thus, they are copper alloys for electrical or electronic parts which are suitable for the material of connectors for cars.

On the other hand, as shown in Table 8, No. 24 (CDA19400) had a high yield strength and a high electric conductivity, but supplied only a low spring limit value of 231 N/mm$^2$, which is insufficient for products for which a high spring limit value is required, such as a connector or a relay. The upper temperature about the resistance property of stress relaxation was 120° C., which is as high as that of phosphor bronze.

No. 25 (Cu—Mg—P alloy disclosed in JP-B-No. 1-54420) had a high yield strength, a high electric conductivity, a high spring limit value and a high resistance property of stress relaxation but had poor bendability and Sn plating property.

Nos. 26 and 27 (alloys wherein Mg, Sn and Zn were added to Cu—Fe alloys deoxidized with P, similar to CDA19400 alloys) had a high yield strength, a high electric conductivity, a high spring limit value and a high resistance property of stress relaxation. However, Si was not added thereto. Thus, recrystallization was not easily caused in any practical intermediate annealing. Therefore, the hardness after the performed intermediate annealing was not uniform and bendability deteriorated.

In No.28, the amount of added Fe was too small. Therefore, the yield strength, the spring limit value, the resistance property of stress relaxation and the bendability thereof were poor though an electric conductivity of 60%IACS or more could be exhibited.

No. 29, wherein the amount of added Si was too large, had an electric conductivity of less than 50% IACS and poor bendability though a high yield strength, a high spring limit value and a high resistance property of stress relaxation were obtained.

In No. 30, the amount of added Si was proper but the amount of added P was too large. Thus, recrystallization was not easily caused in any practical intermediate annealing and the quality of products made of No. 30 became non-uniform. Therefore, the hardness after the performed intermediate annealing was not uniform and the bendability deteriorated.

In No. 31, the amount of added Mg was too large. The rolled texture generated in the cold-rolling step after the hot-rolling was not lost in the intermediate annealing so that uniform and fine recrystallization texture was not obtained. Thus, the bendability was poor. Nos. 32, 33 and 35, wherein the amount of each of added Mg and Sn was improper, the spring limit value (Nos. 32, 33 and 35), the bendability (Nos. 32, 33 and 35) and the resistance property of stress relaxation (No. 35) were poor. No. 34, wherein the amount of added Sn was proper but Mg was not added, had a poor resistance property of stress relaxation. No. 36, wherein the amount of added Mg was proper but Sn was not added, had poor resistance property of stress relaxation and bendability.

No. 37, wherein the amount of added Zn was too small, had a poor Sn plating property.

In No. 38, the amount of added Zn was too large. Zn, which is an element having solid-solution hardening effect, was added together with Sn and Mg, which have the same effect. Therefore, the bendability deteriorated.

In No. 39, the amount of added Ni was too large. Si, which causes an improvement in resistance property of stress relaxation, was used for the formation of Ni—Si intermetallic compounds. Therefore, the resistance property of stress relaxation of No. 39 deteriorated. Moreover, the bendability deteriorated by the formation of the intermetallic compounds.

In No. 40, the amount of added Mn was too large. Si, which causes an improvement in resistance property of stress relaxation, was used for the formation of Mn—Si intermetallic compounds. Therefore, the resistance property of stress relaxation of No. 40 deteriorated. Moreover, the bendability deteriorated by the formation of the intermetallic compounds.

In No. 41, the amount of added Fe was too large. The observation of its sectional texture with the optical microscope and the EDX-SEM demonstrated that coarse Fe grains were generated.

In No. 51, the amounts of added Ti and the like were too large. The observation of its sectional texture with the optical microscope and the EDX-SEM demonstrated that coarse grains of Ti, Cr and Zr were generated. Therefore, the bendability deteriorated extremely.

What is claimed is:

1. A copper alloy for electrical or electronic parts, the alloy consisting essentially of, by weight, Fe: 0.5–2.4%, Si: 0.02–0.1%, Mg: 0.01–0.2%, Sn: 0.01–0.7%, Zn: 0.01–0.2%, Pb: 0.0005–0.015%, P: less than 0.03%, Ni: 0.03 or less, and Mn: 0.03% or less, and further comprising Cu and inevitable impurities as the balance of the copper alloy.

2. The copper alloy according to claim 1, wherein the amount of each of Bi, As, Sb and S is 0.003% or less, the total amount of Bi, As, Sb and S is 0.005% or less, the amount of O is 10 ppm or less, and the amount of H is 20 ppm or less.

3. The copper alloy according to claim 1, further comprising one or more of Be, Al, Ti, V, Cr, Co, Zr, Nb, Mo, Ag, In, Hf, Ta and B in a total amount of 1% or less.

4. The copper alloy according to claim 2, further comprising one or more of Be, Al, Ti, V, Cr, Co, Zr, Nb, Mo, Ag, In, Hf, Ta and B in a total amount of 1% or less.

5. The copper alloy according to claim 1, wherein the Fe is precipitated in the copper alloy.

6. The copper alloy according to claim 1, wherein alloy comprises, by weight, Fe: 1.36–2.4%, and P: 0.008% or less.

7. A method of making a copper alloy, the method comprising forming a melt including Fe, Si, Mg, Sn, Zn, Pb and Cu; and producing the copper alloy of claim 1.

* * * * *